US008858343B2

(12) United States Patent
Filipour et al.

(10) Patent No.: US 8,858,343 B2
(45) Date of Patent: Oct. 14, 2014

(54) SERVER-BASED GAMING CHAIR

(75) Inventors: Cameron Anthony Filipour, Las Vegas, NV (US); Adam Singer, Henderson, NV (US); Alexander Popovich, Henderson, NV (US)

(73) Assignee: IGT, Las Vegas, NV (US)

( * ) Notice: Subject to any disclaimer, the term of this patent is extended or adjusted under 35 U.S.C. 154(b) by 1179 days.

(21) Appl. No.: 12/614,855

(22) Filed: Nov. 9, 2009

(65) Prior Publication Data

US 2011/0109134 A1 May 12, 2011

(51) Int. Cl.

| | |
|---|---|
| ***A63F 13/00*** | (2014.01) |
| ***A63F 13/08*** | (2006.01) |
| ***A47C 15/00*** | (2006.01) |
| ***A47C 7/72*** | (2006.01) |

(52) U.S. Cl.

CPC ..... *A47C 15/004* (2013.01); *A47C 7/72* (2013.01)

USPC ..... 463/47; 463/30; 463/34; 463/35; 463/36; 463/37; 463/42; 463/46

(58) Field of Classification Search

USPC ..... 463/40–42, 46–47

See application file for complete search history.

(56) References Cited

U.S. PATENT DOCUMENTS

| | | | |
|---|---|---|---|
| 4,023,566 | A | 5/1977 | Martinmaas |
| 4,574,391 | A | 3/1986 | Morishima |
| 4,696,370 | A | 9/1987 | Tokumo et al. |
| 4,868,888 | A | 9/1989 | Dayton |
| 5,368,484 | A | 11/1994 | Copperman et al. |
| 5,607,308 | A | 3/1997 | Copperman et al. |
| 5,618,178 | A | 4/1997 | Copperman et al. |
| 5,669,818 | A | 9/1997 | Thorner et al. |
| 5,802,191 | A | 9/1998 | Guenther |
| 5,807,177 | A | 9/1998 | Takemoto et al. |
| 5,889,875 | A | 3/1999 | Caron et al. |
| 6,089,663 | A | 7/2000 | Hill |
| 6,092,867 | A | 7/2000 | Miller |
| 6,145,926 | A | 11/2000 | Lin |
| 6,530,842 | B1 | 3/2003 | Wells et al. |
| 6,611,606 | B2 | 8/2003 | Guenther |
| 6,654,476 | B1 | 11/2003 | Guenther |
| 6,733,293 | B2 | 5/2004 | Baker et al. |
| 6,876,752 | B1 | 4/2005 | Guenther |
| 6,991,543 | B2 | 1/2006 | Joshi |
| 6,993,147 | B2 | 1/2006 | Guenther |
| 7,117,136 | B1 | 10/2006 | Rosedale |

(Continued)

FOREIGN PATENT DOCUMENTS

| | | | |
|---|---|---|---|
| JP | 269332 | H1 | 10/1989 |
| WO | 9315633 | A1 | 2/1993 |

(Continued)

*Primary Examiner* — Ronald Laneau
*Assistant Examiner* — Ross Williams
(74) *Attorney, Agent, or Firm* — Foley & Lardner LLP

(57) ABSTRACT

A gaming chair includes a plurality of speakers, at least one electronic display device, a network interface configured to couple to a network, and a processor coupled to the speakers, the electronic display device, and the network interface. The processor is configured to receive game data from a remote server via the network interface, wherein the game data includes audio signals and video signals, and to cause the speakers to output audio based on the audio signals. The processor is also configured to cause the display device to display at least one image based on the video signals.

2 Claims, 11 Drawing Sheets

(56) References Cited

U.S. PATENT DOCUMENTS

| | | | | |
|---|---|---|---|---|
| 7,125,074 | B2 | 10/2006 | Real et al. | |
| 7,302,076 | B2 | 11/2007 | Guenther | |
| 7,367,886 | B2 | 5/2008 | Loose et al. | |
| 7,479,063 | B2 | 1/2009 | Pryzby et al. | |
| 7,532,737 | B2 | 5/2009 | Guenther | |
| 7,611,409 | B2 * | 11/2009 | Muir et al. | 463/29 |
| 2001/0026087 | A1 | 10/2001 | Tomita | |
| 2002/0150275 | A1 | 10/2002 | Guenther | |
| 2002/0173357 | A1 * | 11/2002 | Yoshida | 463/42 |
| 2003/0044041 | A1 | 3/2003 | Guenther | |
| 2003/0045354 | A1 * | 3/2003 | Giobbi | 463/40 |
| 2004/0076308 | A1 | 4/2004 | Guenther | |
| 2004/0161129 | A1 | 8/2004 | Guenther | |
| 2005/0232456 | A1 | 10/2005 | Guenther | |
| 2005/0277469 | A1 | 12/2005 | Pryzby et al. | |
| 2005/0282631 | A1 | 12/2005 | Bonney et al. | |
| 2006/0009284 | A1 | 1/2006 | Schwartz et al. | |
| 2006/0159301 | A1 | 7/2006 | Guenther | |
| 2006/0215872 | A1 | 9/2006 | Guenther | |
| 2006/0239492 | A1 | 10/2006 | Guenther | |
| 2006/0239493 | A1 | 10/2006 | Guenther | |
| 2007/0021218 | A1 | 1/2007 | Okada | |
| 2007/0098205 | A1 | 5/2007 | Holmi et al. | |
| 2007/0270216 | A1 | 11/2007 | Pryzby | |
| 2008/0039215 | A1 | 2/2008 | Hahn | |
| 2008/0054561 | A1 * | 3/2008 | Canterbury et al. | 273/148 B |
| 2008/0111408 | A1 | 5/2008 | Duran et al. | |
| 2008/0113821 | A1 * | 5/2008 | Beadell et al. | 463/46 |
| 2008/0211276 | A1 | 9/2008 | Rasmussen | |
| 2008/0246321 | A1 | 10/2008 | Canterbury | |
| 2008/0247582 | A1 | 10/2008 | Guenther | |
| 2008/0292117 | A1 | 11/2008 | Guenther | |
| 2009/0197684 | A1 * | 8/2009 | Arezina et al. | 463/42 |

FOREIGN PATENT DOCUMENTS

| | | | |
|---|---|---|---|
| WO | 2006015335 | A1 | 8/1993 |
| WO | 2005117647 | A1 | 12/2005 |
| WO | 2005117648 | A1 | 12/2005 |
| WO | 2005120127 | A1 | 12/2005 |

* cited by examiner

SERVER-BASED GAMING CHAIR

BACKGROUND

The embodiments described herein relate generally to gaming chairs and, more particularly, to gaming chairs that enhance the player experience and personalization.

At least some known gaming chairs are simple portable stools that are positioned in front of gaming machines (e.g., slot machines). A player may sit on the stool while playing the game. While such stools effectively serve the purpose of permitting the player to sit while playing a gaming machine, such stools are not necessarily comfortable and do not draw a player towards playing the particular game.

More recently, gaming machine chairs have been introduced for particular slot machine games. Such chairs include multiple speakers, and audio signals are generated that result in the audio being emitted from the speakers in a surround sound format. More specifically, and with respect to at least one known chair, while the player is playing a game on the gaming machine (i.e., the gaming machine executes a game application), the audio signals generated by the machine are transmitted from the gaming machine to the chair speaker for output while at the same time, audio signals are also transmitted to the gaming machine speakers. Such known gaming chair and gaming machine configurations are "stand-alone" type arrangements in that the gaming machine itself controls generation of the audio signals and there is typically no personalization of such audio for the particular player.

Moreover, at least some known gaming chairs include still displays along a surface, such as a rear surface, of the gaming chair. A still image on such a display may, for example, be related to a product advertisement or a game advertisement. As with the audio, such displays are not personalized for a particular player.

Furthermore, at least some known gaming chairs include a player interface for a player to control game play of a gaming machine. For example, at least some known gaming chairs include a joystick, a trackball, or a connector for receiving player commands from a player-provided input device. With known "stand-alone" machine, the player inputs and corresponding game play are not personalized for the particular player and the gaming machine simply executes the stored software in response to such player inputs, and communicates game results and data in preprogrammed format via the gaming machine display.

BRIEF DESCRIPTION

In one aspect, a gaming chair is provided, including a plurality of speakers, at least one electronic display device, a network interface configured to couple to a network, and a processor coupled to the speakers, the electronic display device, and the network interface. The processor is configured to receive game data from a remote server via the network interface, wherein the game data includes audio signals and video signals, and to cause the speakers to output audio based on the audio signals. The processor is also configured to cause the display device to display at least one image based on the video signals.

In another aspect, gaming system is provided, including a network, at least one gaming machine, at least one gaming chair, and at least one server coupled to the gaming machine and the gaming chair via the network. The gaming machine is configured to display video images representative of a game, and output audio associated with the game. The gaming chair gaming chair includes a plurality of speakers, at least one electronic display device, and a processor coupled to the speakers and to the display device, wherein the processor is configured to receive a player identifier from a player, receive game data from the server, wherein the game data includes audio signals based on the game presented by the one gaming machine, and video signals based on the player identifier. The processor is also configured to cause the speakers to output audio based on the audio signals and cause the display device to display an image based on the video signals.

In another aspect, a method is provided for interfacing between a gaming machine and a gaming chair that are each coupled to at least one server via a network. The method includes coupling the gaming chair to the network, associating the gaming chair with the gaming machine based on a position of the gaming chair within a casino, and receiving game data from the server, wherein the game data includes audio data and video data. The method also includes outputting the audio data via a plurality of gaming chair speakers and a plurality of gaming machine speakers arranged in a multi-channel arrangement, and outputting the video data via at least one gaming chair display device and at least one gaming machine display device.

Another aspect provides a method for interfacing between a gaming machine and a gaming chair that are each coupled to at least one server via a network. The method includes coupling the gaming chair to the network, associating the gaming chair with the gaming machine based on a location of the gaming chair within a casino, and receiving game data from the at least one server, by the gaming chair and the gaming machine, wherein the game data includes audio signals and video signals. The method also includes outputting audio based on the audio signals via a plurality of gaming chair speakers and a plurality of gaming machine speakers, wherein at least the plurality of gaming chair speakers are arranged in a multi-channel arrangement, and outputting video images based on the video signals via at least one gaming chair electronic display device and at least one gaming machine electronic display device.

BRIEF DESCRIPTION OF THE DRAWINGS

The embodiments described herein may be better understood by referring to the following description in conjunction with the accompanying drawings.

DETAILED DESCRIPTION

Exemplary applications of systems, methods, and apparatus according to the present invention are described herein. These examples are provided solely to add context and to aid in the understanding of the invention. It will thus be apparent to one skilled in the art that the present invention may be practiced without some or all of these specific details. In other instances, well known process operations have not been described in detail in order to avoid obscuring the present invention. Other applications are possible, such that the following examples should not be taken as definitive or limiting either in scope or setting. In the detailed description that follows, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used and changes may be made without departing from the spirit and scope of the invention.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Exemplary technical effects of the systems, methods, and apparatus described herein include at least one of: (a) coupling a gaming chair to a network within a gaming system that includes a plurality of gaming machines and at least one server; (b) determining a location of the gaming chair using a location sensor and transmitting the location to the server; (c) comparing, at the server, the location with a previously stored location for the gaming chair to determine whether the gaming chair has been moved, and replacing the previously stored location if the gaming chair has been moved; (d) associating the gaming chair with a particular gaming machine; (e) receiving game data from the server, wherein the game data includes video signals and audio signals; (f) outputting one or more video images via a gaming chair display device based on the video signals; (g) converting the audio signals into a multi-channel format; and (h) outputting audio via a plurality of gaming chair speakers and/or a plurality of gaming machine speakers.

Figure 1:
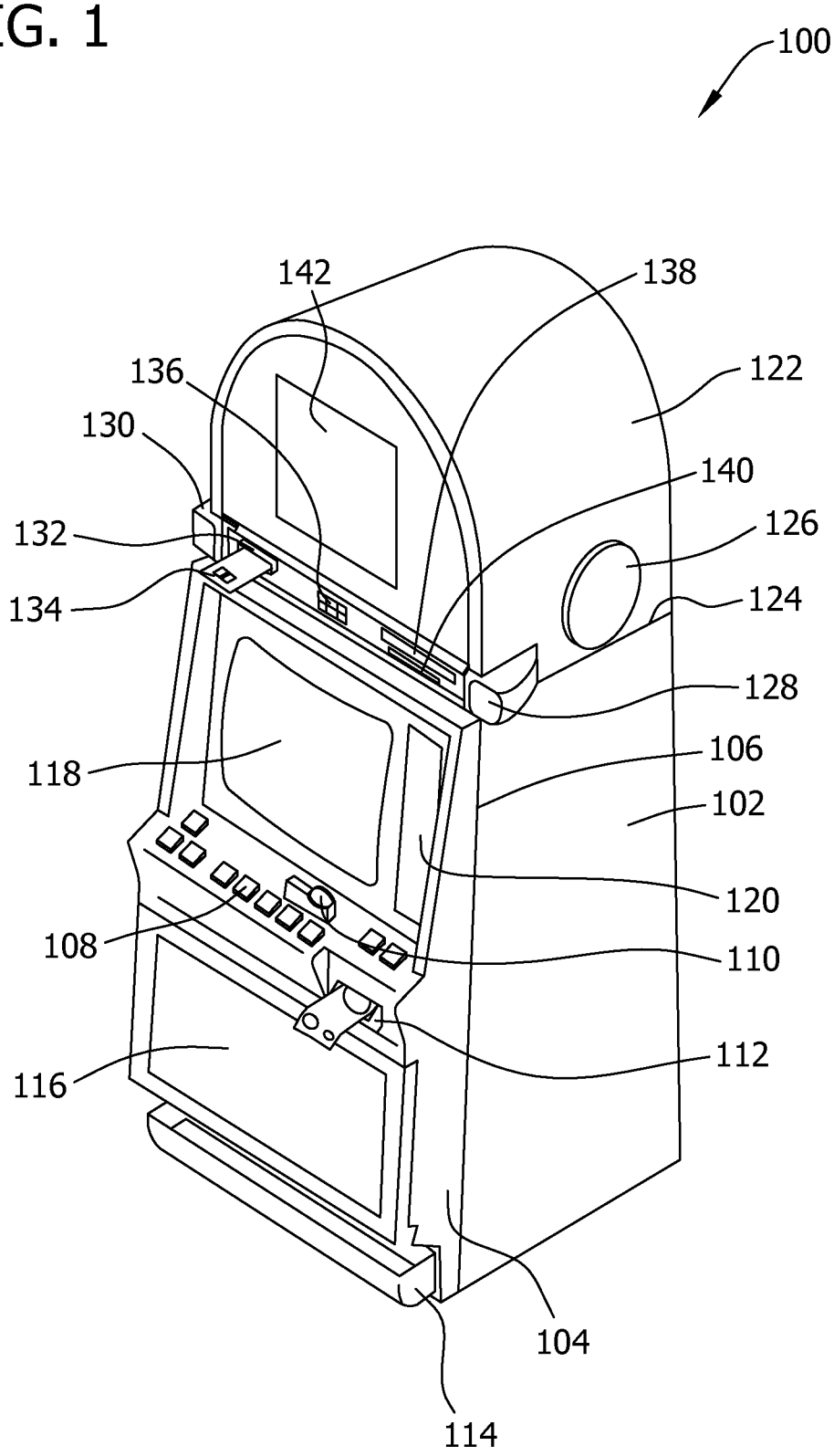
FIG. 1 is a schematic diagram of an exemplary gaming machine.

FIG. 1 is a schematic diagram of an exemplary gaming machine 100. Gaming machine 100 may be any type of gaming machine, and may include, without limitation, different structures than those shown in FIG. 1. Moreover, gaming machine 100 may employ different methods of operation than those described below.

In the exemplary embodiment, gaming machine 100 includes a main cabinet 102 having a main door 104 coupled to a front 106 of gaming machine 100. When opened, door 104 provides access to an interior (not shown) of gaming machine 100. In the exemplary embodiment, a plurality of player-input switches and/or buttons 108 is coupled to main door 104. Moreover, in the exemplary embodiment, a coin acceptor 110, for accepting coins and/or tokens, a bill acceptor 112, for accepting and/or validating cash bills, coupons and/or ticket vouchers, a coin tray 114, for collecting a coin-based payout, and a belly glass 116 are each coupled to main door 104. A primary display device 118 and an information panel 120 are viewable through main door 104. Primary display device 118 may be implemented as a cathode ray tube (CRT), a flat-panel liquid crystal display (LCD), a plasma display, an organic light-emitting diode (OLED) display, a multi-layer display (MLD), or any other electronically-controlled video monitor. Moreover, primary display device 118 may include touch screen capabilities. In the exemplary embodiment, information panel 120 is a back-lit, silk screened glass panel that includes lettering to indicate general game information including, for example, a number of coins wagered. Coin acceptor 110, bill acceptor 112, player-input buttons 108, video display monitor 118, and information panel 120 are each used by a player to play a game on gaming machine 100. Each component 108, 110, 112, 118, and/or 120 is controlled by a gaming machine controller (not shown in FIG. 1) that is housed inside main cabinet 102. Numerous games including, but not limited to only including, video slot games, video poker, video pachinko, video black jack, video card games, and/or video keno may be implemented for play on gaming machine 100.

In the exemplary embodiment, gaming machine 100 also includes a top box 122 that is positioned on a top surface 124 of main cabinet 102. In the exemplary embodiment, top box 122 includes a number of devices that may be used to add features to a game being played on gaming machine 100. Such devices may include, but are not limited to only including, speakers 126, 128, and 130, a ticket printer 132 for printing bar-coded tickets 134, a key pad 136 for entering player tracking information, or player preferences or characteristics, a display 138 for displaying player tracking information and/or player preferences or characteristics, and a card reader 140 for receiving a card containing player tracking information and/or player preferences or characteristics encoded thereon. Card reader 140 may also be used to accept credit cards, printed cards, smart cards, and/or other magnetic stripe cards. Moreover, top box 122 includes a secondary display device 142 that displays, for example, player information, an attract sequence, a bonus game, or any other suitable images. Secondary display device 142 may be implemented as a cathode ray tube (CRT), a flat-panel liquid crystal display (LCD), a plasma display, an organic light-emitting diode (OLED) display, a multi-layer display (MLD), or any other electronically-controlled video monitor. Moreover, secondary display device 142 may include touch screen capabilities. Top box 122 may house additional devices not shown in FIG. 1, such as, for example, a bonus wheel and/or a back-lit silk screened panel that may be used to add bonus features to a game being played on gaming machine 100. During game play, such devices may be controlled by circuitry, such as the gaming machine controller housed within main cabinet 102.

Figure 2:
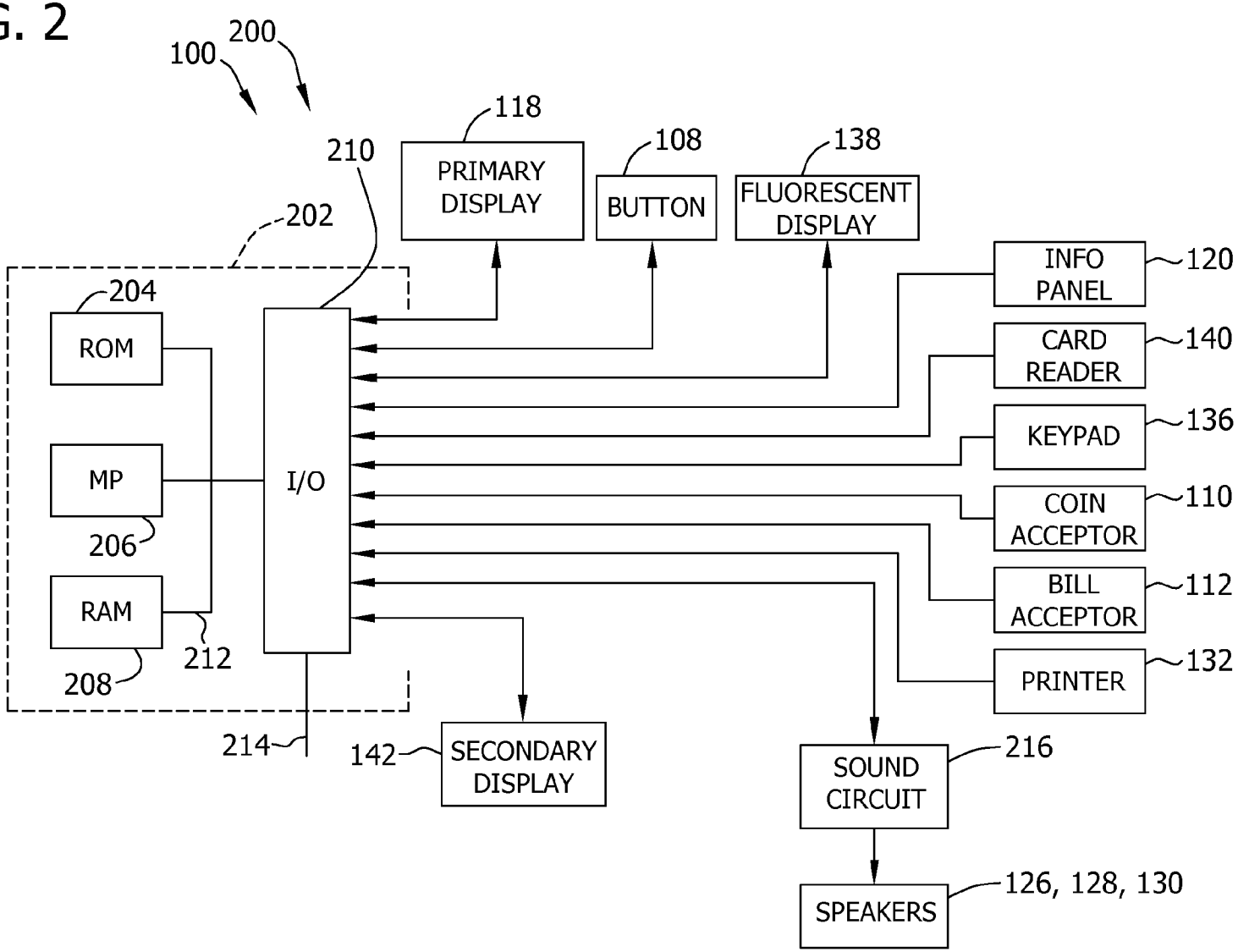
FIG. 2 is a block circuit diagram of an exemplary electrical architecture that may be used with the gaming machine shown in FIG. 1.

FIG. 2 is a block circuit diagram of an exemplary electrical architecture 200 incorporated into an exemplary gaming machine, such as gaming machine 100. In the exemplary embodiment, gaming machine 100 includes a gaming machine controller 202 that includes a read-only memory (ROM) 204, a microcontroller or microprocessor (MP) 206, a random-access memory (RAM) 208, and an input/output (I/O) circuit 210, each coupled via an address/data bus 212. As used herein, the terms "controller," "processor," and "processing unit" may include any programmable system including systems using microcontrollers, reduced instruction set circuits (RISC), application specific integrated circuits (ASICs), logic circuits, a computer, and any other circuit, processor, or processing unit capable of executing the functions described herein. The above examples are exemplary only, and are thus not intended to limit in any way the definition and/or meaning of the terms "controller," "processor," or "processing unit." Alternative embodiments of controller 202 may include more than one microprocessor 206, multiple RAM modules 208, and/or multiple ROM modules 204. Moreover, although I/O circuit 210 is shown in FIG. 2 as a single component, one of ordinary skill in the art will appreciate that I/O circuit 210 may include any number or a plurality of different types of I/O circuits. Further, RAM 208 and/or ROM 204 may be implemented as, for example, semiconductor memories, magnetically readable memories, and/or optically readable memories. In one embodiment, each operational component of gaming machine 100 is coupled to I/O circuit 210 via a respective conductor and/or via bus 212. Alternative embodiments may include a single coupling between the operational components of gaming machine 100 and I/O circuit 210. In the exemplary embodiment, I/O circuit 210 is coupled to a gaming network (not shown) via a network interface 214. Moreover, in the exemplary embodiment, architecture 200 includes a sound circuit 216 that generates audio signals and that communicates the audio signals between I/O circuit 210 and speakers 126, 128, and/or 130.

Figure 3:
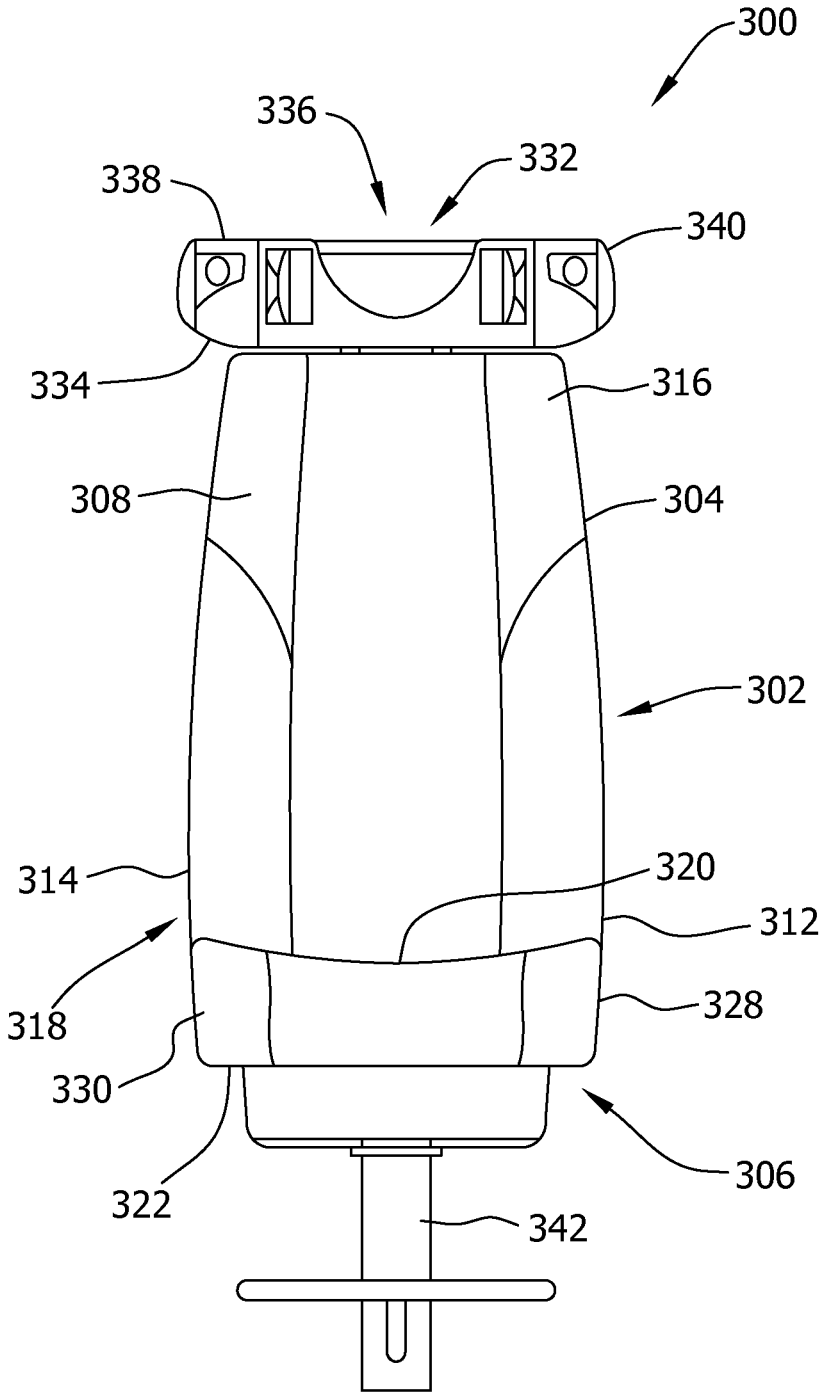
FIG. 3 is a front view of an exemplary gaming chair.
Figure 4:
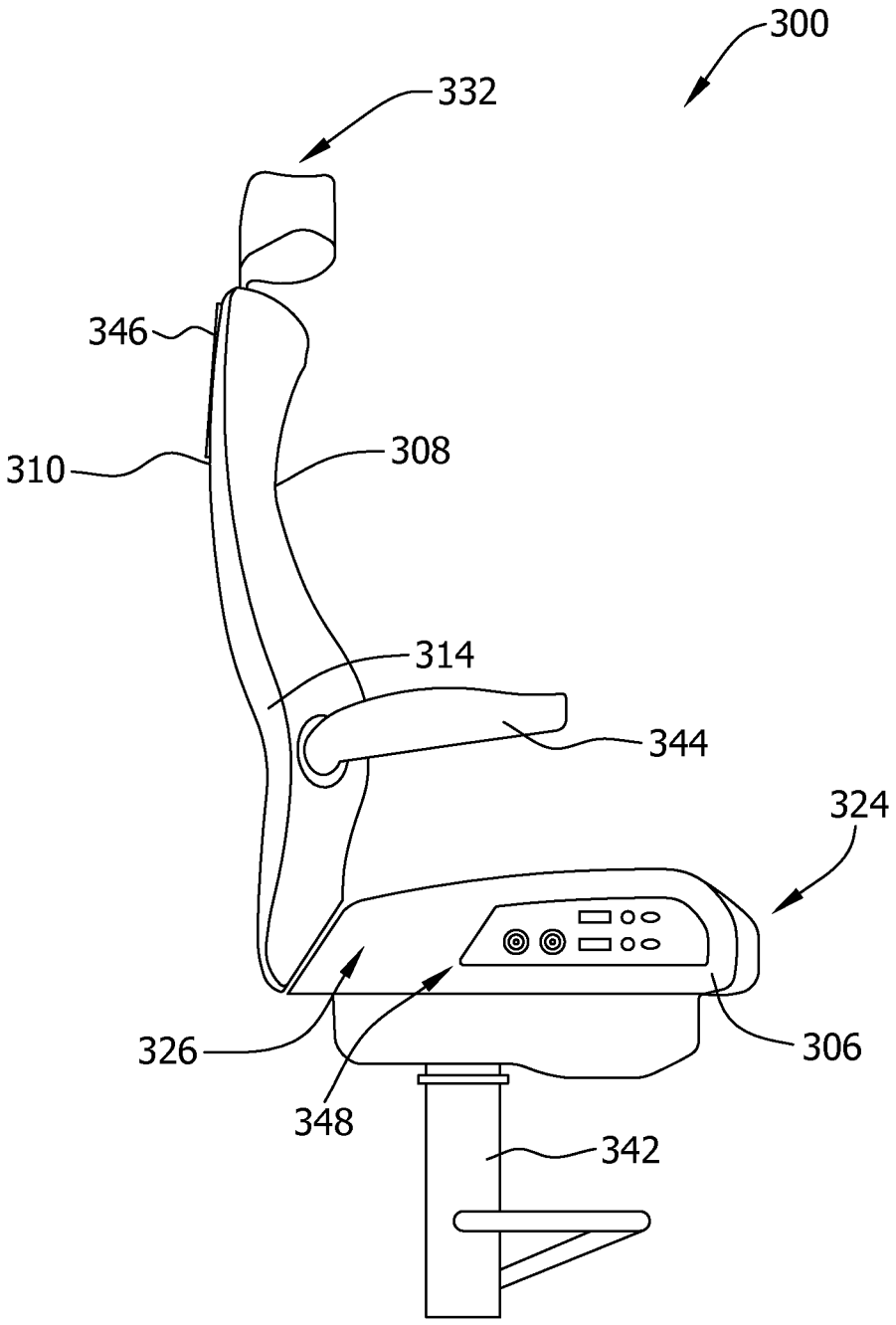
FIG. 4 is a side view of the gaming chair shown in FIG. 3.
Figure 5:
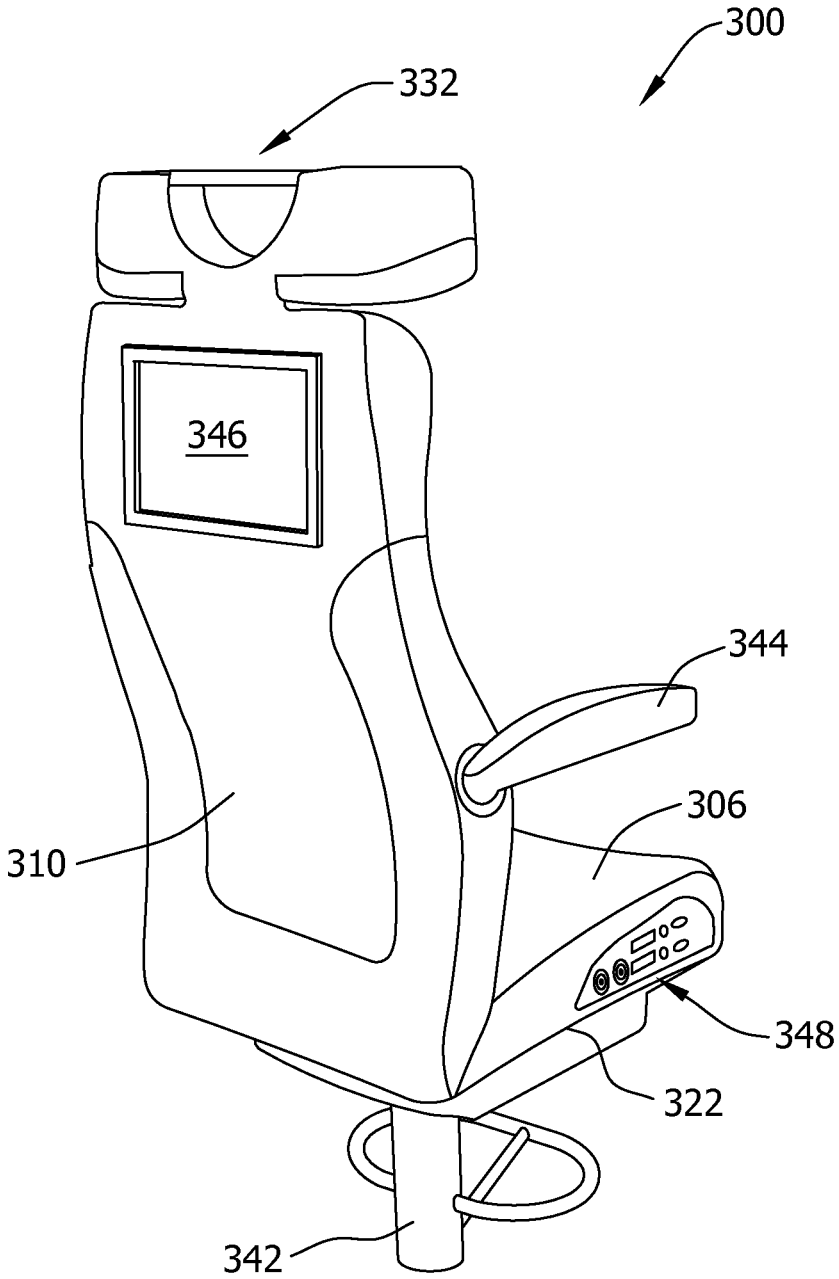
FIG. 5 is a perspective view of the gaming chair shown in FIG. 3.

FIGS. 3-5 are schematic diagrams of an exemplary gaming chair 300 that may be used with gaming machine 100 (shown in FIG. 1). Specifically, FIG. 3 is a front view of gaming chair 300; FIG. 4 is a side view of gaming chair 300; and FIG. 5 is a perspective view of gaming chair 300. In the exemplary embodiment, gaming chair 300 includes a frame (not shown in FIGS. 3-5) and a cushion 302.

As shown in FIGS. 3-5, in the exemplary embodiment, cushion 302 includes a back portion 304 and a seat portion 306. Back portion 304 includes a front surface 308, an opposing rear surface 310, a first side surface 312, and an opposing second side surface 314. Back portion 304 also includes a top surface 316 and an opposing bottom surface 318. Seat portion 306 includes a top surface 320, an opposing bottom surface 322, a front surface 324, and an opposing rear surface 326. Seat portion 306 also includes a first side surface 328 that is oriented in substantially the same plane as first side surface 312, and a second side surface 330 that is oriented in substantially the same plane as second side surface 314. Moreover, in the exemplary embodiment, a speaker assembly 332 is coupled to the frame. Speaker assembly 332 includes a speaker enclosure 334 and a plurality of speakers 336. Specifically, in the exemplary embodiment, speaker assembly 332 includes a left surround speaker 338 and a right surround speaker 340. In an alternative embodiment, speaker assembly 332 also includes a center surround speaker (not shown). Furthermore, in the exemplary embodiment, gaming chair 300 is positioned on a post 342 that couples gaming chair 300 to a surface, such as, but not limited to, a ground surface or a platform surface.

In some embodiments, and as shown in FIGS. 4 and 5, gaming chair 300 also includes a plurality of armrests 344. Each armrest 344 is adjustable such that it may be raised and/or lowered. Moreover, gaming chair 300 includes a display device 346 and a player interface assembly 348. Display device 346 facilitates displaying attract sequences, advertisements, and/or images or messages that are personalized to one or more players, as described in more detail below. Player interface assembly 348 facilitates providing a player control over a game being played on gaming machine 100, as described in more detail below.

Figure 6:
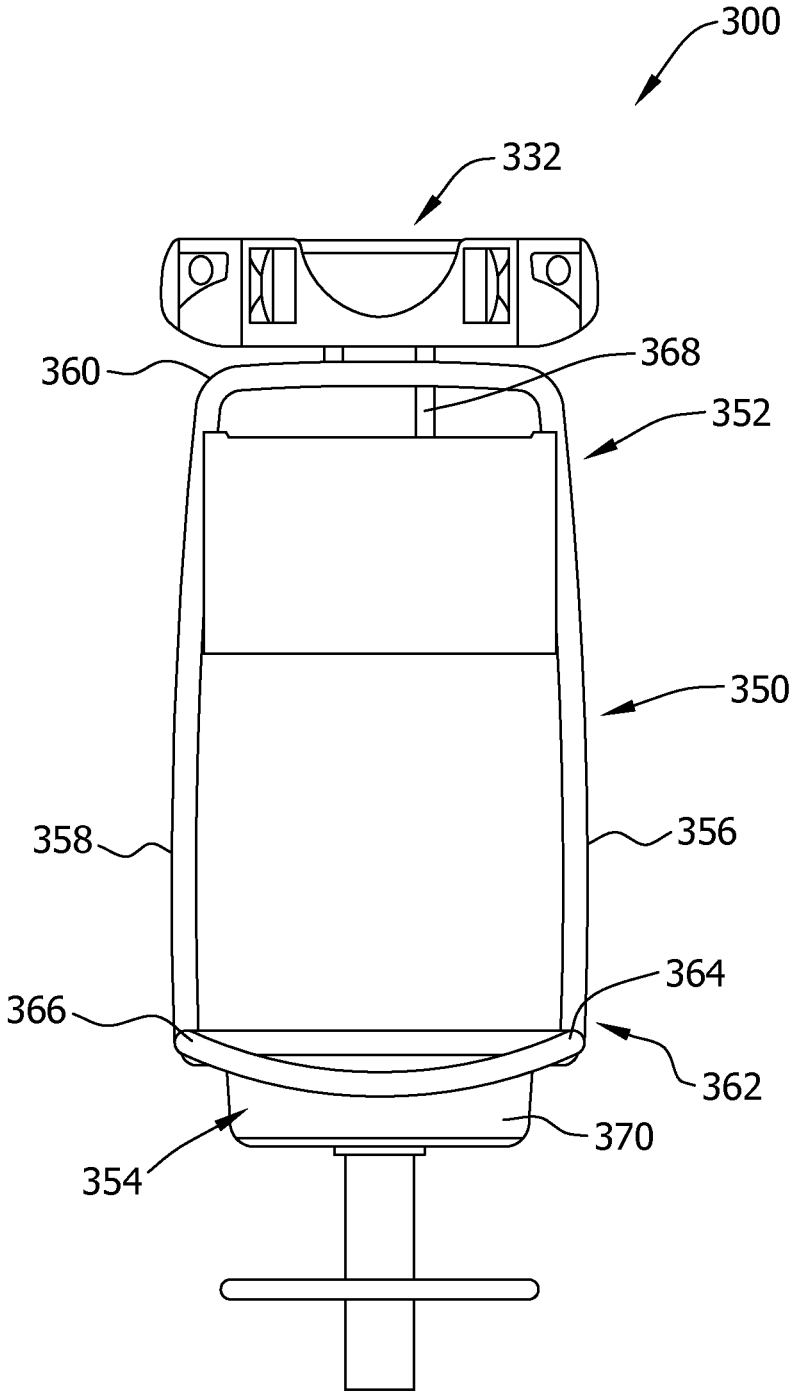
FIG. 6 is a schematic diagram of a frame that may be used with the gaming chair shown in FIG. 3.

FIG. 6 is a schematic diagram of gaming chair 300 without cushion 302 (shown in FIGS. 3-5). In the exemplary embodiment, a frame 350 includes a back portion 352 and a seat portion 354, wherein each portion 352 and 354 are sized to fit within cushion 302. Back portion 352 includes a first side 356, an opposing second side 358, a top end 360, and an opposing bottom end 362. Seat portion 354 includes a first side 364 and an opposing second side 366. In the exemplary embodiment, back portion 352 and seat portion 354 are integrally formed. In an alternative embodiment, back portion 352 is coupled to seat portion 354. As shown in FIG. 6, speaker assembly 332 is coupled to top end 360, and display device 346 is coupled to first and second sides 356 and 358. Moreover, as shown in FIG. 6, speaker assembly 332 is coupled to display device 346 via, for example, a conductor conduit 368 that enables one or more wires or other conductor to be coupled to speaker assembly 332. In the exemplary embodiment, gaming chair 300 also includes a seat enclosure 370. In the exemplary embodiment, enclosure 370 houses a subwoofer (not shown) and/or a controller (not shown). Each of speaker assembly 332, display device 346, and enclosure 370 are accessible to one or more wires or other conductors to facilitate transmitting game data to a subwoofer, a controller, display device 346, and/or speakers 336. More specifically, one or more wires or other conductors may be routed through post 342 in order to reach seat enclosure 370, display device 346, and speaker assembly 332.

Figure 7:
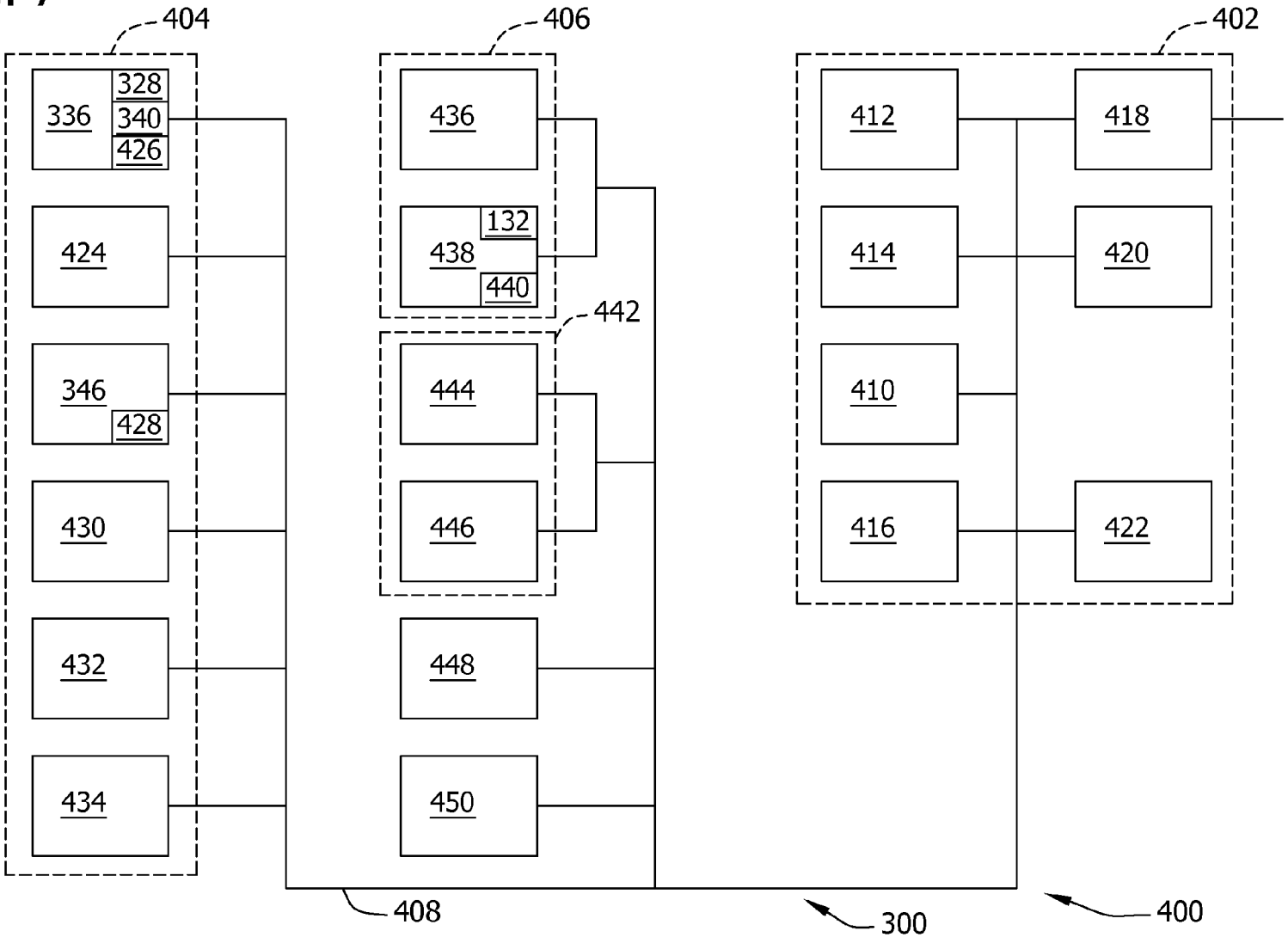
FIG. 7 is a block circuit diagram of an exemplary electrical architecture that may be used with the gaming chair shown in FIG. 3.

FIG. 7 is a block circuit diagram of an exemplary electrical architecture 400 incorporated into an exemplary gaming chair, such as gaming chair 300. In the exemplary embodiment, architecture 400 includes a control system 402, a multimedia system 404, and a game control system 406, each coupled via an internal bus 408.

In the exemplary embodiment, control system 402 is positioned within enclosure 370 (shown in FIG. 6). Moreover, in the exemplary embodiment, control system 402 includes, but is not limited to only including, a read-only memory (ROM) 410, a microcontroller or microprocessor (MP) 412, a random-access memory (RAM) 414, and an internal storage device 416. As used herein, the terms "controller," "processor," and "processing unit" may include any programmable system including systems using microcontrollers, reduced instruction set circuits (RISC), application specific integrated circuits (ASICs), logic circuits, a computer, and any other circuit, processor, or processing unit capable of executing the functions described herein. The above examples are exemplary only, and are thus not intended to limit in any way the definition and/or meaning of the terms "controller," "processor," or "processing unit." Alternative embodiments of control system 402 may include more than one microprocessor 412, multiple RAM modules 414, and/or multiple ROM modules 410. Moreover, RAM 414 and/or ROM 410 may be implemented as, for example, semiconductor memories, magnetically readable memories, and/or optically readable memories. In the exemplary embodiment, internal storage device 416 stores game data, including audio data and video data, associated with one or more games that are available for play at a particular gaming machine 100 or a plurality of gaming machines 100. For example, internal storage device 416 may store game data, such as attract sequences and the like, that is associated with a bank of gaming machines 100.

Furthermore, in the exemplary embodiment, control system 402 includes a network interface 418 and a mobile device interface 420. Network interface 418 maybe a wired connection that couples control system 402 to a network (not shown in FIG. 7) or, alternatively, may be a wireless connection. Exemplary wired communication protocols include, but are not limited to only including, USB, Ethernet, CAN-bus, or any other suitable wired communication protocol. Moreover, in some embodiments, network interface 418 may directly couple speakers 336 and/or display device 346 to a network to facilitate distributing audio and/or video signals. Exemplary wireless communication protocols that facilitate communication between control system 402 and other components coupled to the network include, for example and without limitation, any suitable IEEE 802.11 protocol. Mobile device interface 420 facilitates communicating with devices such as mobile phones, personal digital assistants (PDAs), and the like, using a suitable communication protocol. Examples of such wireless transmission protocols include, but are not limited to only including, infrared (IR) light, Bluetooth®, and ZigBee® (Bluetooth® is a registered trademark of Bluetooth SIG, Inc., Bellevue, Wash., USA, and ZigBee® is a registered trademark of ZigBee Alliance Corporation, San Ramon, Calif., USA). However, one of ordinary skill in the art will appreciate that any other suitable wireless transmission protocol may be used. Control system 402 also includes a location sensor 422 that determines a location of gaming chair 300 within a facility, such as a casino. Location sensor 422 may determine the location of gaming chair 300 using the Global Positioning System (GPS) or any other suitable positioning, navigation, and timing (PNT) system.

In the exemplary embodiment, multimedia system 404 includes, without limitation, plurality of speakers 336, at least one subwoofer 424, electronic display device 346, a media device interface 426, and multimedia controls 428. As described above, plurality of speakers 336 includes left surround speaker 338 and right surround speaker 340 (both shown in FIG. 3). In an alternative embodiment, plurality of speakers 336 also includes a center surround speaker 430. Each speaker 336 is configured to output a specified channel of multi-channel audio. In the event that audio signals received by gaming chair 200 do not have a multi-channel format, each speaker 336 is configured to output audio in stereo in conjunction with gaming machine speakers 126, 128, and 130 (shown in FIGS. 1 *and* 2). In the exemplary embodiment, subwoofer 424 is positioned within enclosure 370. Subwoofer 424 outputs a low-frequency component of the audio signals. In the exemplary embodiment, subwoofer 424 outputs the low-frequency component to facilitate simulating vibration during game play. In an alternative embodiment, enclosure 370 and subwoofer 424 are coupled to frame 350 (shown in FIG. 6). In some embodiments, a plurality of subwoofers 424 is positioned within enclosure 370. In such embodiments, subwoofers 424 are configured to output the low-frequency component of the audio data such that no sound is produced. For example, subwoofers 424 are configured to output the low-frequency component approximately 180° out of phase with each other.

In the exemplary embodiment, display device 346 is positioned along rear surface 310 (shown in FIGS. 4 and 5). More specifically, display device 346 is coupled to frame 350 and extends through cushion 302 (shown in FIGS. 3-5). Display device 346 receives video signals from processor 412 via bus 408. Alternatively, display device 346 receives video signals from a built-in network interface (not shown). The video images displayed by display device 346 may include, without limitation, an attract sequence, an advertisement, an image associated with a game or a gaming machine bank, or any other suitable video image or video sequence. For example, display device 346 may display a player-selected image that is associated with a player and stored in a database (not shown in FIG. 7). In some embodiments, display device 346 is coupled to armrest 344 (shown in FIGS. 4 and 5). Moreover, in some embodiments, display device 346 includes a touch screen component 432 that receives player inputs and/or commands. For example, display device 346 may enable a player to virtually chat, via an instant messaging window, with another player. As another example, display device 346 may enable a player to order food or drink. Further, display device 346 may enable to a player to order tickets to an event, make dinner reservations, or any other suitable service. Display device 346 may be a flat-panel liquid crystal display (LCD), a plasma display, an organic light-emitting diode (OLED) display, a multi-layer display (MLD), or any other electronically-controlled video monitor.

Moreover, in the exemplary embodiment, media device interface 426 enables a player to couple a personal multimedia device to gaming chair 300. For example, a player may wish to listen to his own music collection during a gaming session, and couples his multimedia device to media device interface 426. Processor 412 senses the presence of the multimedia device and causes gaming machine speakers 126, 128, and 130 and/or gaming chair speakers 336 to output audio from the multimedia device rather than audio associated with a game. In addition, multimedia controls 428 enable the player to adjust the volume, fade, and/or balance of the audio output.

Multimedia system 404 also includes an external storage device interface 434 that enables a player to couple a personal storage device to gaming chair 300. For example, a player may wish to display to his own avatar or other personal image during a gaming session, and couples his storage device to storage device interface 434. Processor 412 senses the presence of the storage device and causes display device 446 to display video images from the storage device rather than video images associated with a game.

In the exemplary embodiment, game control system 406 includes a human interface, such as a player input device 436, that receives player commands related to game play at gaming machine 100 and/or game configuration. Input device 436 may be a trackball, a joystick, or any other suitable input device. Moreover, game control system 406 includes a player tracking interface 438. In the exemplary embodiment, player tracking interface 438 receives a player identifier via, for example, touch screen 432, card reader 132, and/or a biometric sensor 440. Player tracking interface 438 transmits the player identifier to processor 412, which transmits the player identifier to a server (not shown in FIG. 7). The server identifies the player based on the player identifier, and transmits player data to gaming machine 100 and/or gaming chair 300, including, for example, player account data and the like.

In some embodiments, gaming chair 300 also includes an environment control system 442 that enables a player to adjust a temperature at a seating surface of gaming chair 300, and/or enables a player to adjust a chair height and other comfort settings. As such, environment control system 442 includes a heating and cooling subsystem 444 that adjusts the temperature using, for example, pressurized air and/or a plurality of heating coils. However, any suitable method of heating and/or cooling cushion 302 may be used. The player may input changes to the temperature via, for example, a knob (not shown) and/or touch screen 432. Moreover, environment control system 442 includes a motor control subsystem 446 that adjusts the chair height and other comfort settings. Motor control subsystem 446 includes a plurality of motors (not shown) that adjust the chair height, lumbar support, massage settings, or other comfort adjustments. The player may input changes to these settings via, for example, touch screen 432. In some embodiment, gaming chair 300 receives a player identifier, such as via insertion of a player tracking card, and transmits the player identifier to a remote processor (not shown) via network interface 418. Based on the player identifier, the remote processor determines preferred gaming chair position data and transmits the position data to control system 402 via network interface 418. Control system 402 transmits the position data to motor control subsystem 446, which adjusts the chair height and other comfort settings. The chair position data may also be used to automatically adjust a temperature at a seating surface of gaming chair 300.

Moreover, in some embodiments, gaming chair 300 includes a plurality of light devices 448 coupled to control system 402. Light devices 448 enable processor 412 to present a lighting effect to a player or a potential player. In one embodiment, light devices 448 are embedded in seams of cushion 302. Processor 412 selectively illuminates light devices 448, using one or more colors, based on a game event or outcome.

Furthermore, in some embodiments, gaming chair 300 includes a proximity sensor 450 coupled to control system 402. Sensor 450 detects when a player or potential player is within a specified distance of gaming chair 300, or when a player has sat in gaming chair 300. Upon detecting a presence of a player or potential player, sensor 450 transmits a signal to processor 412. In response to the signal, processor 412 may, for example, initiate an attract sequence via display device 346, illuminate at least a portion of light devices 448, or any other suitable sequence of events.

Figure 8:
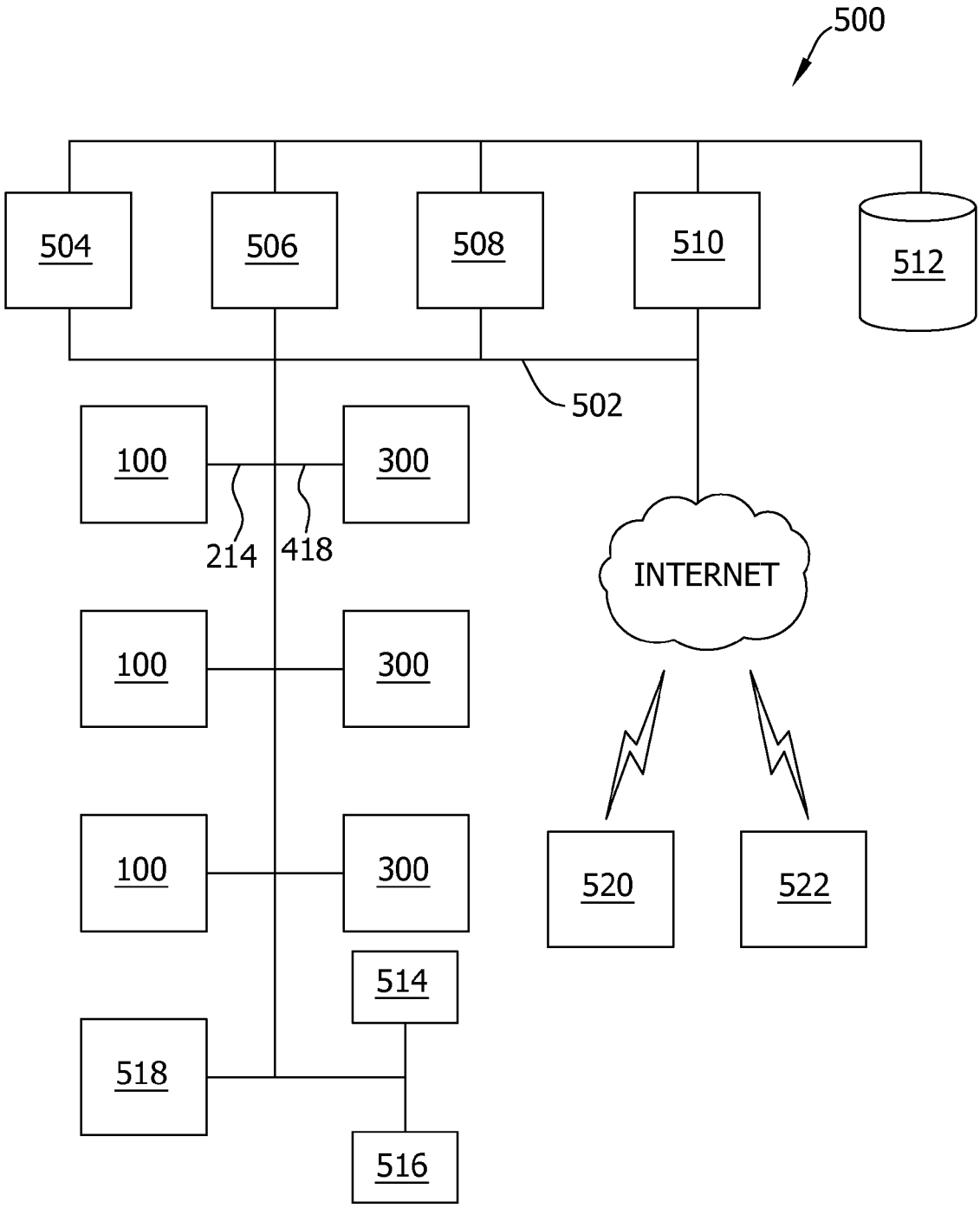
FIG. 8 is a block schematic diagram of an exemplary gaming system.

FIG. 8 is a block schematic diagram of an exemplary gaming system 500 that includes a plurality of gaming machines 100 and a plurality of gaming chairs 300, wherein each gaming chair 300 is paired to a particular gaming machine 100. Each gaming machine 100 is coupled via network connection 214 and a network 502 to one or more servers, such as a gaming server 504, an accounting server 506, a player tracking server 508, and/or a facility server 510. Similarly, each gaming chair 300 is coupled via network interface 418 to one or more servers, such as gaming server 504, accounting server 506, player tracking server 508, and/or facility server 510. Each server 504, 506, 508, and 510 includes a processor (not shown) that facilitates data communication between each gaming machine 100, each gaming chair 300, and other components of gaming system 500. Such data is stored in, for example, a database 512 that is coupled to each server 504, 506, 508, and 510. Moreover, each server 504, 506, 508, and 510 also includes audio capabilities, such as a CD-ROM drive (not shown) or DVD-ROM drive (not shown), that are coupled to a sound card (not shown) for processing and transmitting digitized sound effects to one or more speakers 514 in response to commands issued over gaming system 500 by a corresponding server 504, 506, 508, and/or 510. Each server 504, 506, 508, and 510 is also coupled via network 502 to an electronic sign or screen 516 that displays information, such as via scrolling and/or flashing messages that indicate, for example, progressive and/or jackpot amounts, and that are visible to players playing gaming machines 100. Messages for display on each electronic screen 516 are generated and/or modified in response to commands issued over gaming system 500 by servers 504, 506, 508, and/or 510.

As described above, gaming machines 100 may include video poker machines, video slot machines, and/or other similar gaming machines that implement alternative games. Moreover, gaming machines 100 may be terminal-based machines, wherein the actual games, including random number generation and/or outcome determination, are performed at a server, such as servers 504, 506, 508, and/or 510. In such an embodiment, gaming machine 100 displays results of the game via primary display device 118 (shown in FIG. 1).

Moreover, in the exemplary embodiment, gaming system 500 includes a configuration workstation 518 that includes a user interface that enables an administrator to set up and/or to modify portions of gaming system 500 and/or servers 504, 506, 508, and 510. Player tracking server 508 tracks data of players using gaming machines 100, and also controls messages that appear on each display device 118 and 142 and/or information panel 120 of gaming machines 100. In the exemplary embodiment, player tracking server 508 also stores physical characteristics of players, such as the player age and/or vision data. Gaming server 504 controls bonus applications or bonus systems that award bonus opportunities on gaming system 500. Moreover, gaming server 504 includes a set of rules for awarding jackpots in excess of those established by winning pay tables (not shown) of each gaming machine 100. Some bonus awards may be awarded randomly, while other bonus awards may be made to groups of gaming machines 100 operating in a progressive jackpot mode. Player tracking server 508 may store data related to the players tracked by a player tracking identification, such as a player card. Moreover, player tracking server 508 may store information and data about the player such as loyalty points, player address, phone number, and the like that may be retrieved and transmitted to the gaming server 504. Accounting server 506 may store and track information such as the average amount of wager played by the player, any funds the player may have in an account, and the like.

In the exemplary embodiment, facility server 510 stores a location of each gaming chair 300 within a facility, such as a casino or an airport. Specifically, each gaming chair 300 determines its location within the facility using location sensor 422 (shown in FIG. 7). Gaming chair 300 transmits the location to facility server 510 via network 502, and facility server 510 stores the location in a memory (not shown) and/or in database 512. In addition, gaming chair 300 transmits an identifier to facility server 510, and facility server 510 links the identifier to the stored location. In some embodiments, each gaming machine 100 also transmits an identifier and a location to facility server 510, which enables facility server 510 to associate a particular gaming chair 300 with a particular gaming machine 100 and/or a particular gaming machine bank. Moreover, in the exemplary embodiment, facility server 510 detects when gaming chair 300 has been moved to a new location. Specifically, upon receiving a location and identifier from gaming chair 300, facility server 510 compares the previously stored location with the newly received location. If the newly received location is different than the stored location, facility server 510 stores the newly received location in a memory and/or database 512. In on embodiment, facility server 510 also detects that gaming chair 300 has been moved to a new gaming machine bank, and transmits new game data to gaming chair 300 for use in presenting audio data and video data to players.

Furthermore, in the exemplary embodiment, facility server 510 transmits audio and/or video signals to gaming chair 300 based on a location of gaming chair 300 with respect to a service establishment, such as a bar, restaurant, or club. For example, facility server 510 monitors the time of day such that, near the evening hours when it is common for players to have dinner, facility server 510 transmits video and/or audio signals to gaming machine 300 that relates to a nearby restaurant. The video images displayed by display device 346 may include an advertisement and/or a discount for meals during a certain time period. In addition, facility server 510 transmits video and/or audio signals to gaming chairs 300 within a common gaming machine bank such that presentation of the video images and/or audio may be sequenced to provide a coordinated display. In some embodiment, facility server 510 stores preferred gaming chair position data for use in automatically adjusting a position of gaming chair 300 and/or a temperature at a seating surface of gaming chair 300.

In the exemplary embodiment, gaming system 500 includes one or more remote computers 520 and/or mobile devices 522, such as a cell phone or PDA, that access system 500 via an external network, such as the Internet. Facility server 510 enables a player to reserve a particular gaming machine 100 or game, and transmits video and/or audio signals to an associated gaming chair 300 to help the player locate the reserved gaming machine 100 or a particular gaming machine 100 that provides the reserved game. For example, a player may access a casino web site using remote computer 520 and/or mobile device 522 in order to reserve a particular gaming machine 100. Facility server 510 determines an identifier for an associated gaming chair 300, and determines when the player arrives at the casino and/or approaches the associated gaming chair 300. Facility server 510 then transmits video and/or audio signals to gaming chair 300 that identifies for the player the reserved gaming machine 100.

Figure 9:
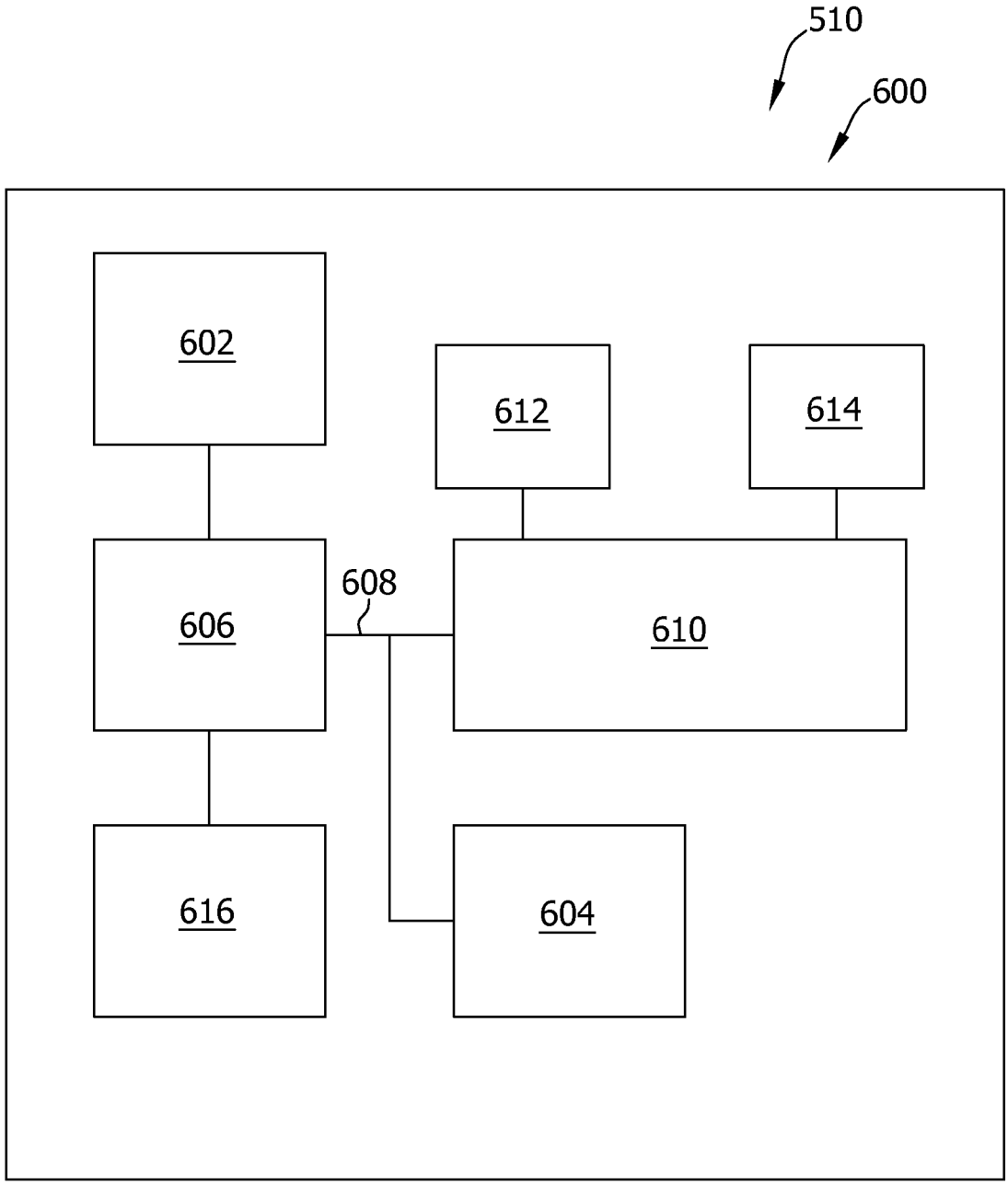
FIG. 9 is a schematic block diagram of an exemplary electrical architecture of a facility server that may be used with the gaming system shown in FIG. 8.

FIG. 9 is a schematic block diagram of an exemplary electrical architecture 600 of facility server 510. In the exemplary embodiment, facility server 510 includes a network interface 602 that facilitates communication between server 510 and gaming system 300 (shown in FIG. 8). Interface 602 is not intended to be limiting as any combination of hardware and software may be used as desired to allow the various input/output devices to communicate with facility server 510. Moreover, facility server 510 includes one or more memory modules 604, such as a read-only memory (ROM) and/or a random-access memory (RAM). Memory 604 is coupled to a microcontroller or central processor unit (CPU) 606 via an address/data bus 608. As used herein, the terms "controller," "processor," and "processing unit" may include any programmable system including systems using microcontrollers, reduced instruction set circuits (RISC), application specific integrated circuits (ASICs), logic circuits, a computer, and any other circuit, processor, or processing unit capable of executing the functions described herein. The above examples are exemplary only, and are thus not intended to limit in any way the definition and/or meaning of the terms "controller," "processor," or "processing unit." Alternative embodiments of architecture 600 may include more than one processor 606 and/or multiple memory modules 604. Further, memory 604 may be implemented as, for example, semiconductor memory, magnetically readable memory, and/or optically readable memory.

In some embodiments, facility server 510 also includes a configuration manager 610 that enables a user to setup, configure, and/or modify settings 612 and promotions or advertisements 614 related to locations and/or identifiers of gaming machines 300. Settings 612 may be any parameters such as default volume, default attraction sequence, whether to enable a player to use a personalized image or set of game audio data, external multimedia device support, and the like. Configuration manager 610 may be used in cooperation with or configuration workstation 518 (shown in FIG. 8).

In the exemplary embodiment, facility server 510 also includes a promotion communicator 616 that is coupled to processor 606. Promotion communicator 616 gathers the necessary data and information from, for example, accounting server 506 and player tracking server 508 (both shown in FIG. 8). In some embodiments, a casino may have separate systems for player tracking, accounting, cage and credit system, and the like. Thus, in order for the various promotions to be offered, facility server 510 communicates and obtains information from each of the various systems. For example, promotion communicator 616 communicates with player tracking server 508 to retrieve information about the player to determine the player's eligibility to participate in a promotion, as described in more detail below.

Figure 10:
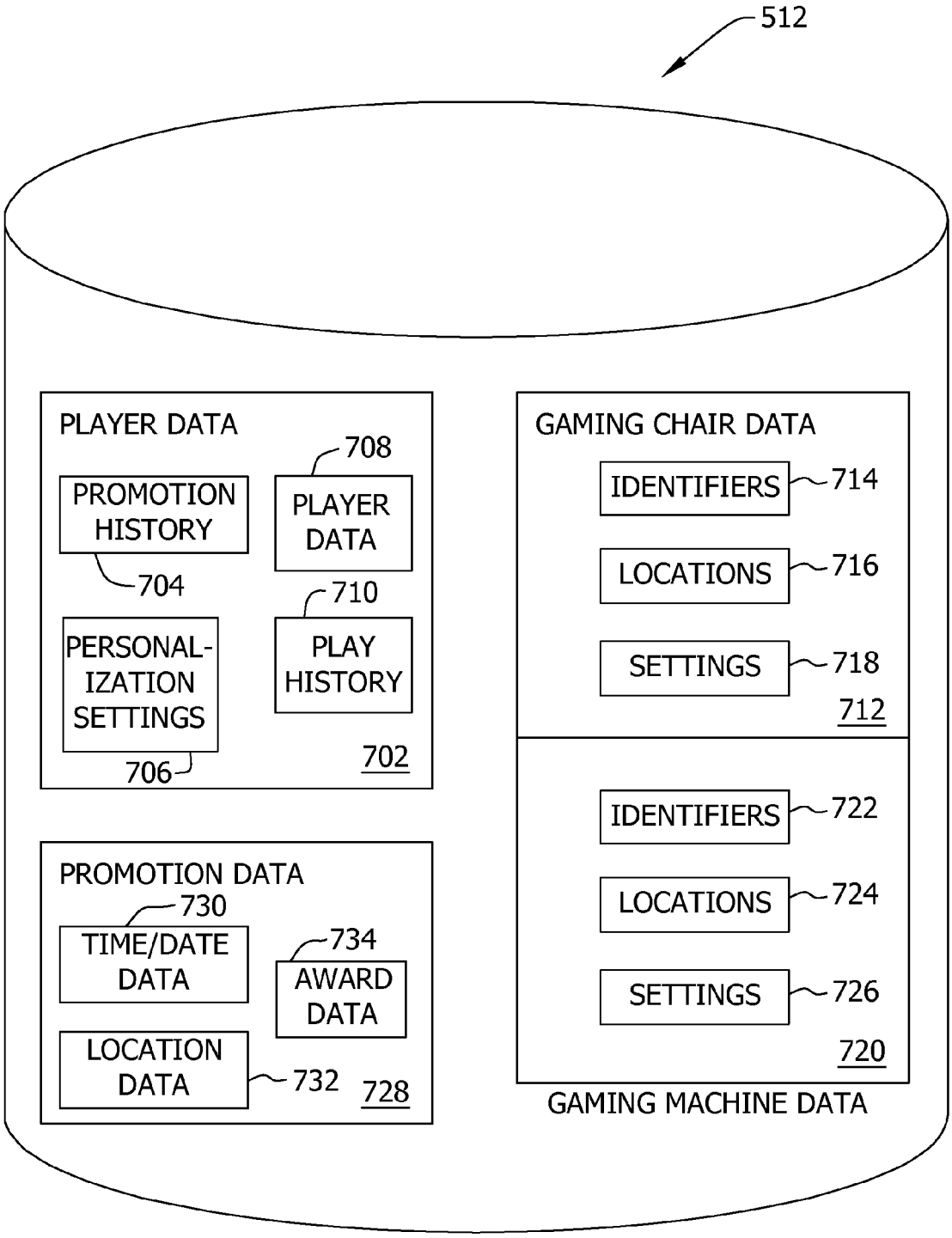
FIG. 10 is a schematic block diagram of a plurality of data storage tables of a database that may be used with the gaming system shown in FIG. 8.

FIG. 10 is a schematic block diagram of a plurality of data storage tables of database 512. In some embodiments, database 512 may be implemented by a plurality of databases 512. In the exemplary embodiment, database 512 stores player data 702 such as a player's promotion history 704. Promotions in which the player has previously participated may be saved in the database 512 and may be used to determine and/or customize future bonuses and/or promotions offered to the player. Personalization settings 706, such as a player-selected image or avatar, may also be saved in database 512.

Player data records 708 may be obtained from player tracking server 508 (shown in FIG. 8) and saved in database 512. The information includes a player's ratings, number of points accumulated in a loyalty program, the player's residence, and any other information necessary to determine the player's eligibility to participate in a bonus event or promotional event. Additionally, play history records 710 may be stored in database 512. Play history records 710 may be used to customize the bonuses and/or promotions offered to the player to keep a player's interest in playing a game of chance.

Database 512 also stores gaming chair data 712, which may be any information related to gaming chairs 300 (shown in FIG. 8). For example, gaming chair data 712 may include, but is not limited to only including, a unique identifier 714 for each gaming chair 300, a location 716 for each gaming chair 300, and settings 718 for each gaming chair 300, such as volume settings, temperature settings, and/or position and comfort settings. Such settings may include default values and/or customized values that are entered via, for example, configuration workstation 518 (shown in FIG. 8). Identifiers 714 may be, for example, a MAC address of network interface 418 (shown in FIG. 7).

In the exemplary embodiment, database 512 also stores gaming machine data 720, which may be any information related to gaming machines 100 (shown in FIG. 8). For example, gaming machine data 720 may include, but is not limited to only including, a unique identifier 722 for each gaming machine 100, a location 724, such as a bank identifier, for each gaming machine 100, and settings 726 for each gaming machine 100. Identifiers 722 may be, for example, a MAC address of network interface 214 (shown in FIG. 2). Settings 726 may include, for example, default position settings, speaker volume settings, and/or environmental settings.

Moreover, in the exemplary embodiment, database 512 stores promotion data 728. For example, promotion data 728 may include, but is not limited to only including, time and date data 730 for each promotion, location data 732 related to each promotion, and award data 734 for each promotion. For example, time and date data 730 may include a time period during which gaming chair 300 displays an advertisement for a bonus event, service establishment, or the like. Location data 732 may include particular areas of the casino in which an advertisement should be displayed by gaming chair 300. Award data 734 may include an award, such as a number of credits or a discount on goods or services, that is awarded to a player and/or advertised by gaming chair 300.

Figure 11:
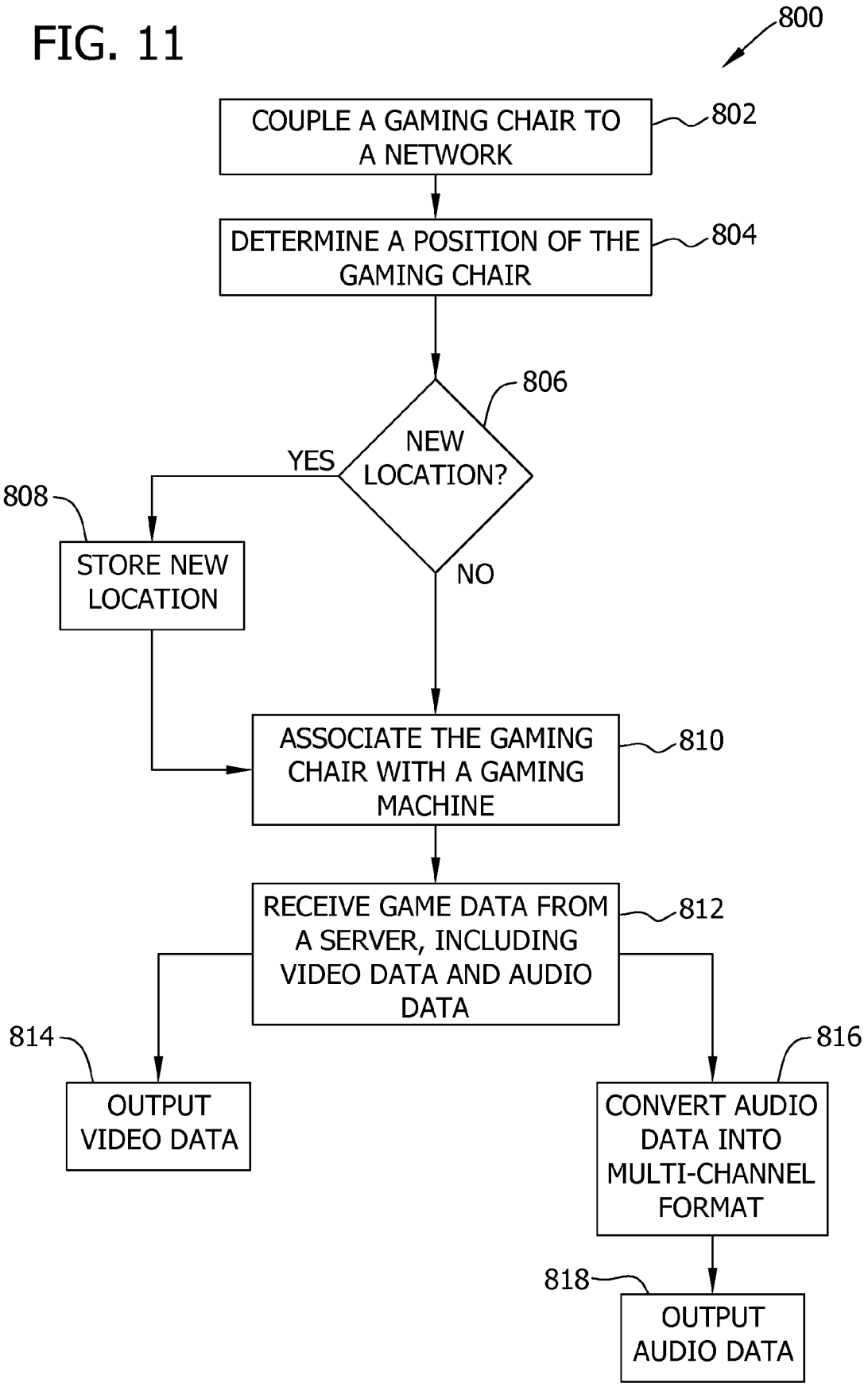
FIG. 11 is a flowchart 800 that illustrates a method for interfacing between a gaming machine and a gaming chair.

FIG. 11 is a flowchart 800 that illustrates a method for interfacing between a gaming machine, such as gaming machine 100 (shown in FIGS. 1 and 2), and a gaming chair, such as gaming chair 300 (shown in FIGS. 3-7).

In the exemplary embodiment, gaming chair 300 is coupled 802, such as communicatively coupled, to network 502 (shown in FIG. 8). Specifically, network interface 418 (shown in FIG. 7) is coupled to network 502 to enable communication between gaming chair 300 and servers 504, 506, 508, and/or 510 (each shown in FIG. 8). In the exemplary embodiment, network interface 418 is coupled to network 502 using a wired connection. In an alternative embodiment, network interface 418 is a wireless interface that enables gaming chair 300 to communicate with servers 504, 506, 508, and/or 510 using a suitable wireless communication protocol. In some embodiment, gaming chair 300 receives a player identifier, such as via insertion of a player tracking card, and transmits the player identifier to facility server 510 via network 502. Based on the player identifier, facility server 510 determines preferred gaming chair position data and transmits the position data to control system 402 via network interface 418 (both shown in FIG. 7). Control system 402 transmits the position data to motor control subsystem 446 (shown in FIG. 7), which adjusts the chair height and other comfort settings. The chair position data may also be used to automatically adjust a temperature at a seating surface of gaming chair 300.

In the exemplary embodiment, gaming chair 300 determines 804 a location using location sensor 422 (shown in FIG. 7). Location sensor 422 may detect, for example, GPS coordinates of gaming chair 300. Gaming chair 300 transmits the location to facility server 510. Facility server 510 determines 806 whether the location is a new location. Specifically, facility server 510 determines a stored location 716 (shown in FIG. 10) associated with a stored identifier 714 (shown in FIG. 10) in database 512 (shown in FIG. 8). If gaming chair 300 has been moved, facility server 510 stores 808 the new location 716 in memory 604 (shown in FIG. 9) and/or database 512. Facility server 510 associates 810 gaming chair 300 with a particular gaming machine 100 (shown in FIG. 1).

Gaming chair 300 then receives 812 game data from one or more server 504, 506, 508, and/or 510. The game data may be based on, without limitation, a game played on gaming machine 100 and/or a gaming machine bank associated with gaming machine 100. For example, the game data may be related to a bonus event, a winning outcome, a bonus win, and/or an upcoming promotional jackpot event. Alternatively, the game data may be related to an advertisement for a service establishment such a restaurant, bar, or spa. Such an advertisement may be broadcast by facility server 510, for example, to all gaming chairs 300 at a particular time of day. Alternatively, an advertisement may be broadcast only to gaming chairs 300 that are located near such establishments. Moreover, the game data may also be related to an attract sequence.

Gaming chair 300 then outputs the game data. Specifically, processor 412 (shown in FIG. 7) causes display device 346 (shown in FIG. 7) to output 814 one or more video images. Gaming machine display 118 (shown in FIG. 1) also outputs one or more video images. In the exemplary embodiment, display device 346 is located along a portion of rear surface 310 of cushion 302 (both shown in FIG. 5). In addition, processor 412 converts 816 audio signals into a multi-channel format, and causes speakers 336 (shown in FIG. 7) to output 818 the converted audio. Gaming machine speakers 126, 128, and 130 (shown in FIG. 1) also output at least a portion of the audio. In some embodiments, the converted audio signals include a low-frequency component that is output by one or more subwoofers 424 (shown in FIG. 7). In one embodiment, subwoofers 424 are configured to output the low-frequency component 180° out of phase to facilitate providing a player with a sensation of vibration. In an alternative embodiment, speakers 336 output audio in normal stereo mode.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming chair for being positioned at a gaming machine and communicatively coupled in a network including at least one server remote from the gaming machine, said gaming chair comprising:

a backrest portion having a first end and a second end;

a seat portion located at the first end of the backrest portion;

a network interface configured to communicatively couple to the network;

a game control system, said game control system coupled to said network interface and comprising a human interface for allowing a human operator to provide inputs to the at least one server via said network interface;

a media device interface configured to receive a player controlled media device;

a proximity sensor;

a plurality of speakers, wherein the plurality of speakers includes a left channel speaker, a right channel speaker, a center channel speaker, and a subwoofer, wherein the subwoofer is positioned within an enclosure in the seat portion, wherein the left channel speaker, the right channel speaker, and the center channel speaker are positioned at the second end of the backrest portion;

a display device coupled to the backrest portion; and a processing unit coupled to said network interface, the game control system, the media device interface, the proximity sensor, the plurality of speakers, and the display device, said processing unit configured to;

receive audio signals from the player controlled media device and cause the plurality of speakers to output the audio signals received from the player controlled media device;

customize game play at the gaming machine according to inputs received via the game control system;

control game play at the gaming machine according to inputs received via the game control system;

receive at least one of audio and video related signals from said network interface, detect that a player is within a specified distance of the proximity sensor, and in response to detecting the player, cause the plurality of speakers to output audio based on the audio signals received from the network interface and cause the display device to output video based on the video signals received from the network interface, and receive inputs from said game control system and transmit the inputs to the at least one server via said network interface.

2. A gaming chair in accordance with claim 1, wherein said electronic display device is configured to display at least one image, the at least one image being at least one of an attract sequence, an advertisement, and an image associated with a bank of gaming machines.

* * * * *